US007467922B2

(12) United States Patent
Beeck et al.

(10) Patent No.: US 7,467,922 B2
(45) Date of Patent: Dec. 23, 2008

(54) COOLED TURBINE BLADE OR VANE FOR A GAS TURBINE, AND USE OF A TURBINE BLADE OR VANE OF THIS TYPE

(75) Inventors: Alexander Ralph Beeck, Orlando, FL (US); Stefan Irmisch, Jupiter, FL (US)

(73) Assignee: Siemens Aktiengesellschaft, Munich (DE)

( * ) Notice: Subject to any disclaimer, the term of this patent is extended or adjusted under 35 U.S.C. 154(b) by 501 days.

(21) Appl. No.: 11/214,302

(22) Filed: Aug. 29, 2005

(65) Prior Publication Data

US 2007/0020100 A1 Jan. 25, 2007

Related U.S. Application Data

(60) Provisional application No. 60/702,313, filed on Jul. 25, 2005.

(51) Int. Cl.
*F01D 5/18* (2006.01)

(52) U.S. Cl. ..... 416/97 R; 416/96 R; 415/115

(58) Field of Classification Search ..... 416/90 R, 416/96 R

See application file for complete search history.

(56) References Cited

U.S. PATENT DOCUMENTS 5,820,343 A * 10/1998 Kraft et al. ..... 416/96 A 6,402,471 B1 * 6/2002 Demers et al. ..... 416/97 R

FOREIGN PATENT DOCUMENTS

EP 1 355 041 A2 10/2003

* cited by examiner

*Primary Examiner*—Edward Look
*Assistant Examiner*—Dwayne J White

(57) ABSTRACT

The invention relates to a turbine blade or vane for a gas turbine, having a blade or vane root, which is successively adjoined by a platform region with a transversely running platform and then a blade or vane profile which is curved in the longitudinal direction, having a platform surface, which is provided at the platform and can be exposed to hot gas, and having at least one cavity, which is open on the root side, through which a coolant can flow and which extends through the blade or vane root and at least into the platform region and is surrounded by an inner wall, the contour of which, running in the platform region, is set back with respect to the contour running in the blade or vane root, so as to form a recess. To provide a turbine blade or vane which has a service life which is extended with respect to fatigue while at the same time saving cooling air, the invention proposes that the recess, as a partial cavity, is set back so deep into the platform that it lies opposite the platform surface, forming an at least partially hollow platform, and that there is at least one means for diverting the coolant into the partial cavity.

9 Claims, 6 Drawing Sheets

COOLED TURBINE BLADE OR VANE FOR A GAS TURBINE, AND USE OF A TURBINE BLADE OR VANE OF THIS TYPE

CROSS REFERENCE TO RELATED APPLICATION

This application claims the benefit of U.S. Provisional Patent Application Ser. No. 60/702,313, filed Jul. 25, 2005.

FIELD OF THE INVENTION

The invention relates to a turbine blade or vane for a gas turbine, having a blade or vane root, which is successively adjoined by a platform region with a transversely running platform and then a blade or vane profile which is curved in the longitudinal direction, having at least one cavity which is open on the root side, through which a coolant can flow and which extends through the blade or vane root and the platform region into the blade or vane profile. The invention also relates to the use of a turbine blade or vane of this type.

BACKGROUND OF THE INVENTION

EP 1 355 041 A2 has disclosed a turbine blade or vane of this type. The cast turbine blade has a cavity which extends from the blade root through the platform into the blade profile. The cross section of the cavity is substantially constant along its extent. The cavity is surrounded by an inner wall and has a cross section which is enlarged only in the region of the platform, by virtue of the inner wall being set back in the region of the platform. The material thickness in the transition region between blade profile and platform projecting transversely to it consequently remains constant, so that the transition between them can be cooled more successfully.

SUMMARY OF THE INVENTION

The invention presented is directed toward a turbine blade or vane for a gas turbine, comprising a blade or vane root that is successively adjoined by a platform region with a transversely extending platform and then a blade profile that is curved in the longitudinal direction a platform surface that is provided at the platform and exposed to hot gas; and at least one cavity that is open on the root side, through which a coolant can flow and which extends through the blade or vane root and at least into the platform region and is surrounded by an inner wall, the contour of which, extending in the platform region, is set back with respect to the contour running in the blade or vane root so as to form a recess which widens the cavity, wherein the recess that widens the cavity extends into the region below the platform surface so as to form an at least partially hollow platform and in that there is at least one means for diverting the coolant into the partial cavity.

Moreover, FIG. 2 shows a perspective view of a hollow turbine blade 30 which is designed as a rotor blade and is known from the prior art. The turbine blade 30 comprises a blade root 32, on which a platform 34 and then a blade profile 36 are arranged along a blade axis. The blade profile 36 is not illustrated in its full height, but rather in a shortened form. The cavity which is provided in the turbine blade 30 for cooling purposes is not shown, for the sake of clarity. Both the platform 34 and the blade root 32 extend in a straight line along an axial direction A, with respect to the installation position of the gas turbine blade. FIG. 3 shows the cavity 58, which extends from the blade root 32 into the blade profile 36 and within which a coolant can flow.

FIG. 3 shows the turbine blade 30 illustrated in FIG. 2 in the form of a cross-sectional illustration. On account of the blade root 32 which is rectilinear in the axial direction A and the rectilinear platform 34 formed parallel to it, platform overhangs 46 with different platform widths B projecting transversely to the axial direction A are formed along this axial direction A.

While the gas turbine is operating, mechanical centrifugal force loads and thermal stresses occur at the turbine blade between the relatively cold, thin-walled blade profile and the often hotter platform. The high stresses in the platform and in the transition region limit the fatigue service life of the turbine blade as a whole. Moreover, particularly in the case of turbine blades with a high diverting action and accordingly a strong curvature the fatigue service life is further reduced by the platforms which in sections overhang on one side. The wide platform overhangs are difficult to cool, and high thermal stresses, which also restrict the fatigue service life, may be formed there in particular.

Moreover, the difficulty in cooling the platform is on the one hand that of guiding the cooling air into the platform and on the other hand that of establishing as uniform as possible a dissipation of heat in order to lengthen the fatigue service life, while at the same time taking account of the need to make economical use of cooling air.

Therefore, it is an object of the invention to provide a turbine blade or vane for a gas turbine in which the fatigue service life is lengthened while at the same time cooling air is saved. A further object of the invention is to provide the use of a turbine blade or vane of this type.

The object relating to the turbine blade or vane is achieved by a turbine blade or vane of the generic type which is designed with the features of the claims.

The invention is based on the discovery that the platform can be cooled in a particularly simple way if the recess which widens the cavity projects into the region below the platform surface, so as to form an at least partially hollow platform, and at least one means for diverting the coolant into the partial cavity is provided.

The platforms which are of hollow design can be produced by the use of suitable cores when casting the turbine blade or vane. On account of the recess projecting into the platform, therefore, transitions between blade profile and platform which, as seen in cross section, have a constant material thickness, are possible. In particular as a result of this, it is possible to reduce the thermal stresses in the transition region and in the platforms, which has a beneficial effect on the service life of the turbine blade or vane. The invention therefore institutes a step which is a significant advance on the quoted prior art.

To enable coolant to flow into the recess, there is at least one means for diverting the coolant into the partial cavity. Without a means of this type, cooling air which flows in on the root side would simply flow through the turbine blade or vane in the radial direction. Only standing swirls or what are known as dead water regions, in which a small proportion of the cooling air would be recirculated, would be formed in the recesses running transversely with respect to the radial direction. The use of these means forces the coolant which flows in at the root side to be diverted in the direction of the recess, so that as a result coolant flows around the rear side of the platform surface. This leads to extremely effective convective cooling of the transition and of the platform.

Advantageous configurations are given in the subclaims.

Open platform cooling can be achieved if at least one outlet opening, through which the coolant can flow out of the partial cavity, is provided in the partial cavity as means for guiding the coolant. The outlet opening is provided in the vicinity of the platform edge, so that coolant can flow into the recess and can flow out again on the opposite side. It is advantageous for the outlet opening to open out into the platform surface. This allows film cooling of the platform as well as convective cooling, in order to effectively protect particularly hot regions of the platform from hot gas.

If, on the other hand, the outlet opening opens out into an end side of the platform, it is advantageously possible to block a gap which is formed by the end-side longitudinal edges of platforms of adjacent gas turbine blades or vanes from the penetration of hot gas.

In a further advantageous configuration of the invention, a pin which is located in the cavity and extends from the blade or vane root into the platform region is provided as means for guiding the coolant. This pin divides the cavity into two supply passages which run close to the surface. Accordingly, coolant which flows therein is guided relatively close to the inner wall of the passage for the purpose of cooling the turbine blade or vane.

The configuration in which the pin, in the platform region, has a widening, which diverts the coolant, which can flow along the pin, in the direction of the partial cavity, is particularly effective. The widening which extends in the transverse direction causes the coolant which flows in radially through the supply passages to be diverted in the transverse direction into the hollow platform.

In a further advantageous configuration of the invention, at least one guiding element, which is L-shaped in cross section, extends from the blade or vane root toward the platform region as means for guiding the coolant, so as to form supply passages, the limbs of which guiding element, at the end located in the platform region, at least partially project into the hollow partial cavity. This allows the coolant which flows into the supply passages to be diverted particularly effectively into the partial cavity, since the L-shaped guiding element runs parallel to the inner wall which delimits the cavity and the partial cavity. On account of the L-shaped guiding element, the coolant which is diverted into the partial cavity is guided to the platform edge, where it can then flow radially outward and then back inward around the free end of the limb of the L-shaped guiding element. On account of the flow conditions which are present in the turbine blade or vane, the coolant then flows onward in the direction of the blade or vane profile and during this period cools the transition region between blade profile and platform extremely effectively.

On account of the uniform platform cooling and the uniform cooling of the transition, the fatigue service life of the turbine blade or vane can be effectively lengthened in this configuration.

In a variant of the invention, at least one guiding element extends from the blade or vane root toward the platform region as means for guiding the coolant, until it merges into an inner wall, delimiting the cavity, of the blade or vane profile.

The abovementioned cooling concepts can be used particularly effectively in a turbine blade or vane in which the blade or vane root runs in the longitudinal direction of the blade profile, and the platform has two platform longitudinal edges bent parallel and running in the longitudinal direction, and in which the respective blade or vane root surface facing the suction-side and pressure-side profile walls is convexly and concavely curved in a corresponding way to the associated platform longitudinal edge. In a turbine blade or vane of this type with a curved blade or vane root and a curved platform, a pressure-side platform and a suction-side platform, each having an approximately constant platform width along the main blade or vane part, automatically result along the longitudinal direction. Constant platform widths of this type are heated more uniformly and accordingly can be combined particularly successfully with the cooling concepts according to the invention.

Cooling concepts of this nature can be used to advantageous effect even if the suction-side and/or pressure-side platform overhang are designed as platform stubs with a relatively short platform width.

It is preferable for the turbine blade or vane to be cast and to have a blade or vane root which, when seen in cross section, is in dovetail, hammer or fir tree shape.

The object relating to a use of the turbine blade or vane is achieved by the features of claim 12. It is proposed that the turbine blade or vane as claimed in one of claims 1-11 be used in a preferably stationary gas turbine.

BRIEF DESCRIPTION OF THE DRAWINGS

The invention is explained with reference to figures, in which.

DETAILED DESCRIPTION OF THE INVENTION

Figure 1:
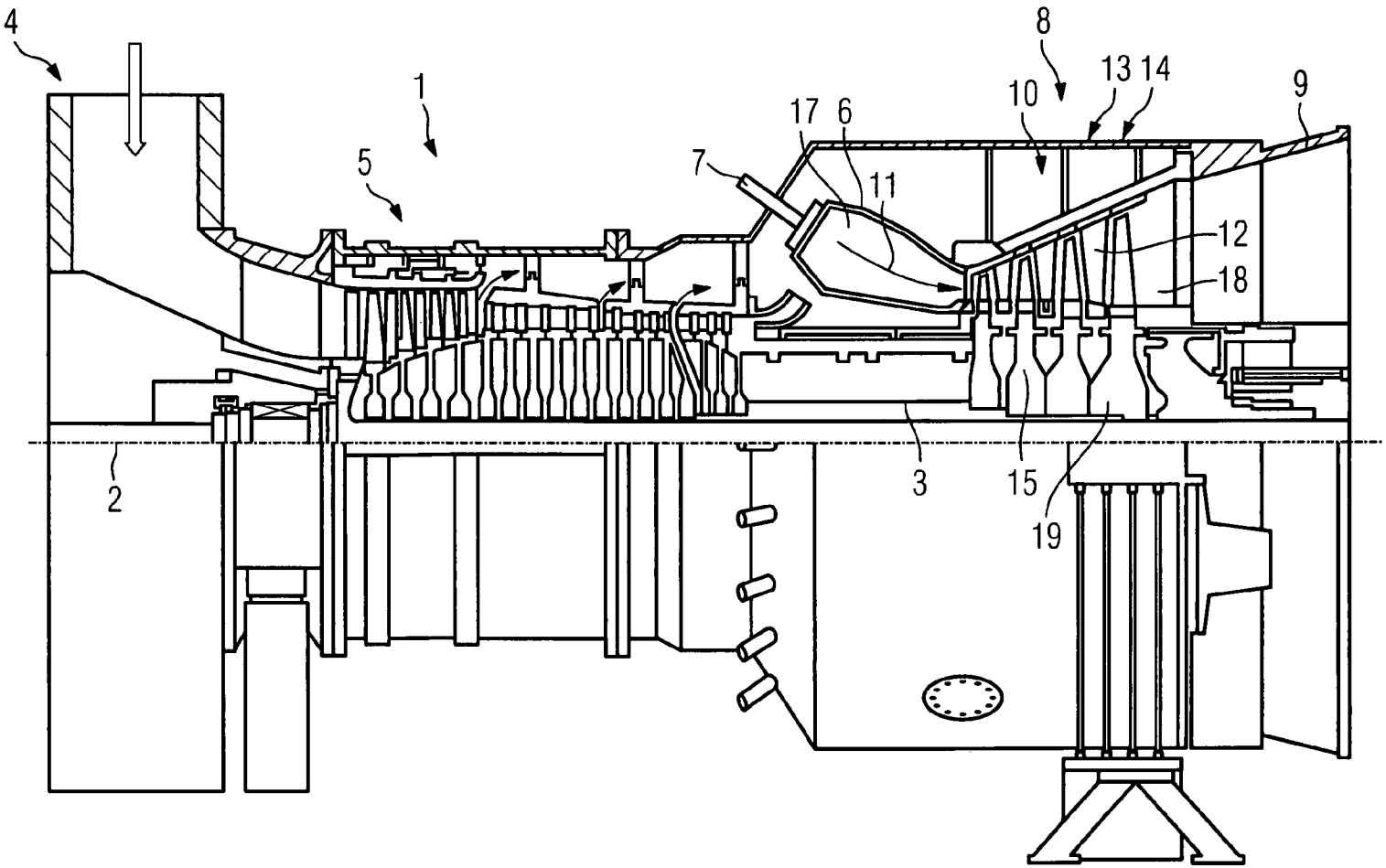
FIG. 1 shows a partial longitudinal section through a gas turbine.
Figure 2:
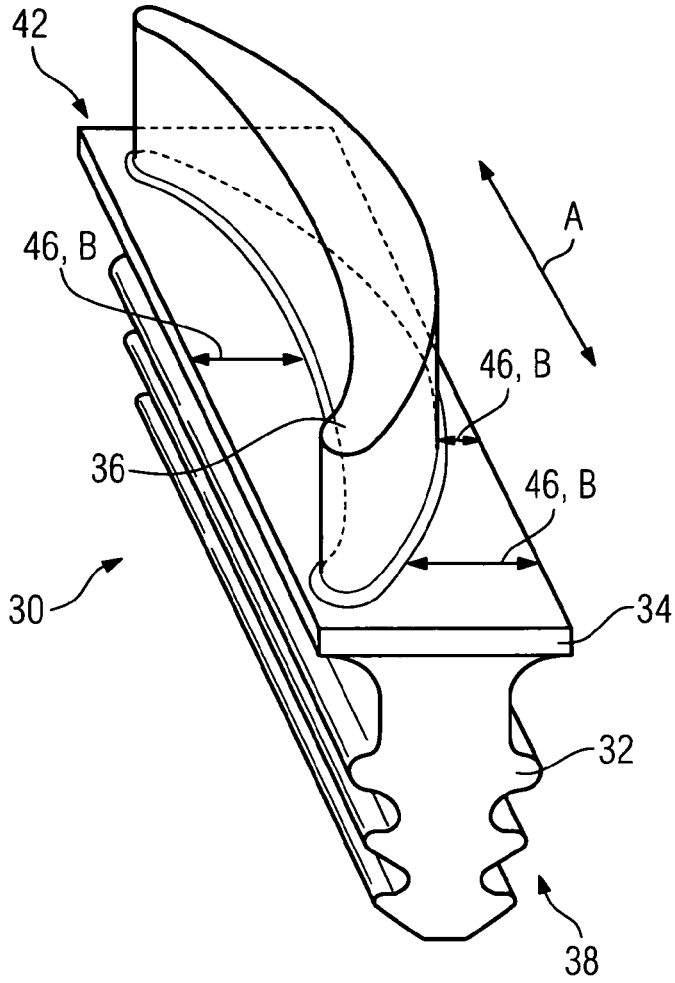
FIG. 2 shows a known turbine blade in the form of a perspective view with overhanging platform regions.
Figure 3:
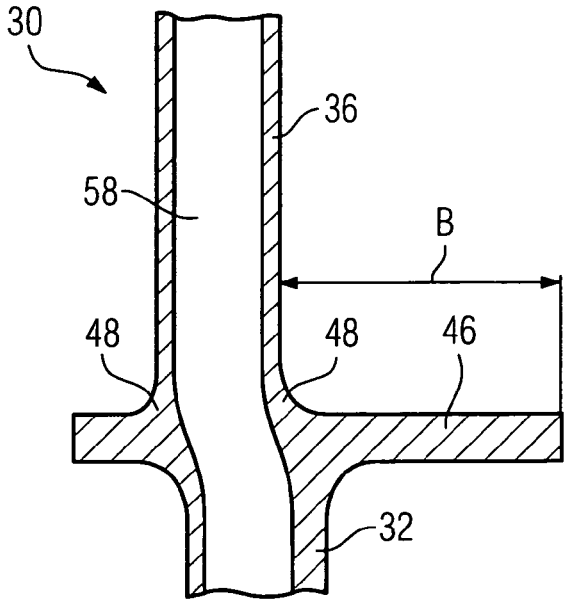
FIG. 3 shows the known turbine blade in cross section with asymmetric platforms which project a long distance.

FIG. 1 shows a partial longitudinal section through a gas turbine 1. In its interior, it has a rotor 3 which is mounted such that it can rotate about an axis of rotation 2 and is also referred to as the turbine rotor. An intake casing 4, a compressor 5, a toric annular combustion chamber 6 with a plurality of burners 7 arranged rotationally symmetrically with respect to one another, a turbine unit 8 and an exhaust gas casing 9 follow one another along the rotor 3. The annular combustion chamber 6 forms a combustion space 17 which is in communication with an annular hot gas duct 18. There, four successive turbine stages 10 form the turbine unit 8. Each turbine stage 10 is formed from two blade or vane rings. As seen in the direction of flow of a hot gas 11 generated in the annular combustion chamber 6, a guide vane row 13 is in each case followed by a row 14 formed from rotor blades 15 in the hot gas duct 18. The guide vanes 12 are secured to the stator, whereas the rotor blades 15 of a row 14 are arranged on the rotor 3 by means of a turbine disk 19. A generator (not shown) is coupled to the rotor 3.

Figure 4:
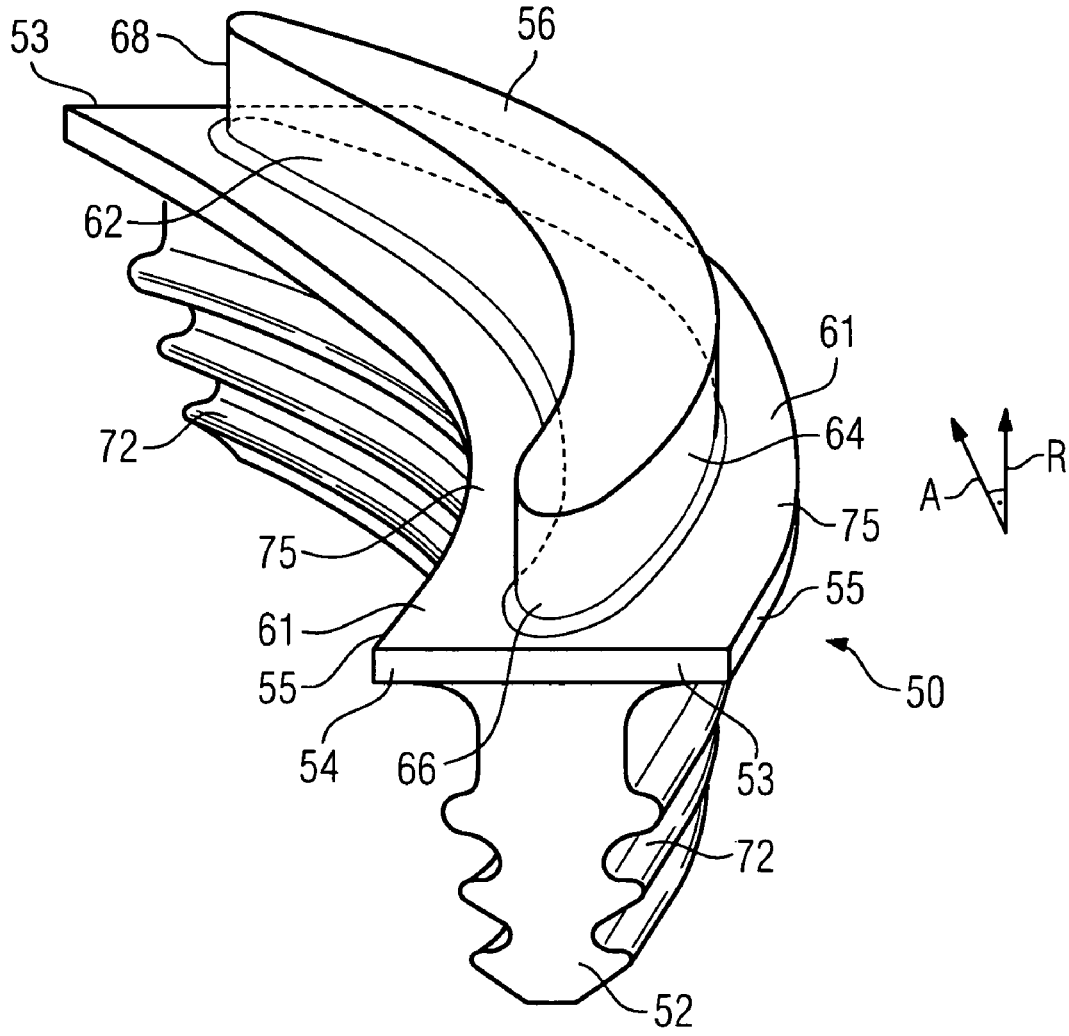
FIG. 4 shows a perspective view of a turbine blade according to the invention with curved blades, FIG. 5, 6 show a turbine blade according to the invention in cross section with an open platform cooling in the form of two variants, FIG. 7, 8, 9 show turbine blades according to the invention in cross section in a configuration with closed platform cooling.

FIG. 4 shows a turbine blade 50 according to the invention, which is designed as a rotor blade and has a blade root 52, on which a platform 54 and a blade profile 56 are provided in succession. The blade profile 56, installed in the gas turbine 1, is curved in the axial direction A. For reasons of clarity, the figure does not illustrate the full height of the blade profile 56, but rather the latter ends relatively close to the platform 54. That surface 61 of the platform 54 which faces the blade profile 56 is exposed to the hot gas 11 flowing through the gas turbine 1.

The blade profile 56 has a pressure-side, concavely curved profile wall 62 and a suction-side, convexly curved profile wall 64, which extend from a leading edge 66 of the blade profile 56 to a trailing edge 68. When the gas turbine 1 is operating, the hot gas 11 flows around the turbine blade 50, along the profile walls 62, 64, from the leading edge 66 toward the trailing edge 68.

In a corresponding way to the curvature of the blade profile 56, the platform 54 is curved along the axial direction A, the longitudinal edges 55 of the platform 54 do not run in a straight line, but rather on an arc. Accordingly, the platform longitudinal edge 54 arranged at the pressure-side profile wall 62 is curved concavely and the platform longitudinal edge arranged at the suction-side profile wall 64 is curved convexly. The platform 54 has a platform transverse edge 53, which runs transversely at the end side, in the region of the leading edge 66 and in the region of the trailing edge 68.

As can be seen from the perspective illustration presented in FIG. 4, the blade root 52 is curved parallel to the longitudinal edges 55 of the platform 54. The blade root 52 is shaped in such a manner that the respective blade root surface 72 facing the suction-side and pressure-side profile walls 62, 64 is convexly and concavely curved in accordance with the platform longitudinal edges 55. It is preferable for all the lines of curvature of the blade root surface 72 which run in the axial direction A to run on an arc of a circle parallel to the platform longitudinal edges 55. Then, the gas turbine blade 50 can be particularly easily pushed into a rotor disk 19 with correspondingly curved rotor blade holding grooves.

The blade root surface 72 is to be understood as meaning that surface of the blade root 52 which runs in the axial direction A. The end-side blade root surfaces are excluded from this term.

The platform 54 has a platform overhang 75 projecting transversely with respect to the radial direction, i.e. in the transverse direction. The width of the platform overhang 75 is determined by the distance from suction-side profile wall 64 or pressure-side profile wall 62 to the respectively immediately adjacent platform longitudinal edge 55.

On account of the curved shape of the blade root 52, it is possible to realize platform overhangs 75 which, along the axial direction A, have an approximately constant platform width B on the suction side and on the pressure side, in a particularly successful way. On account of the constant platform width B, the platform can be cooled particularly uniformly, as described below.

In accordance with the cross-sectional illustrations presented in FIG. 5-FIG. 11, the turbine blade 50 illustrated in FIG. 4 is of hollow design. Consequently, it has a cavity 58 which extends from the blade root 52 through the platform 54 into the blade profile 56. The cavity 58 is delimited by an inner wall 59, the contour of which, in the region of the platform 54, is set back toward the platform edge or platform longitudinal edge 55.

When the gas turbine 1 is operating, the cavity 58 has a coolant 60, preferably cooling air, flowing through it. For the coolant 60 to be supplied, the cavity 58 in the blade root 52 is open on the root side. Based on the installation position in the gas turbine 1, the turbine blade 50, in the region of the platform 54, has a recess 63 which runs transversely with respect to the radial direction R and extends sufficiently deep into the platform 54 for it to lie opposite the surface 61 of the platform 54 as a partial cavity 51 therein.

The recess 63 extends over at least 30% of the width B of the platform overhang 75. On account of the pocket-shaped recess 63 extending relatively deep into the platform 54 compared to the prior art, it is possible not only to realize extremely efficient cooling of the transition region 48 of blade profile 36 and platform 54 running transversely to it, but also to realize efficient internal, convective cooling of the platform 54 and/or of the platform overhang 75.

Figure 5:
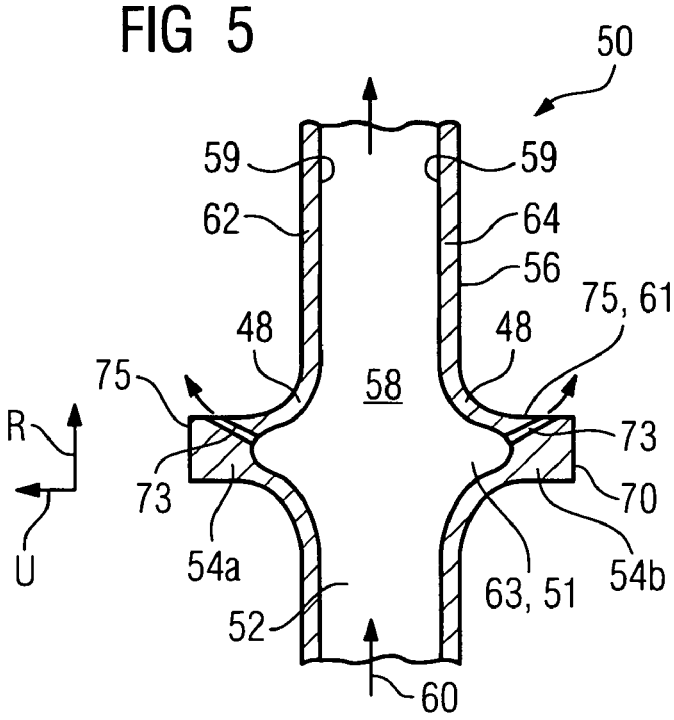
Figure 6:
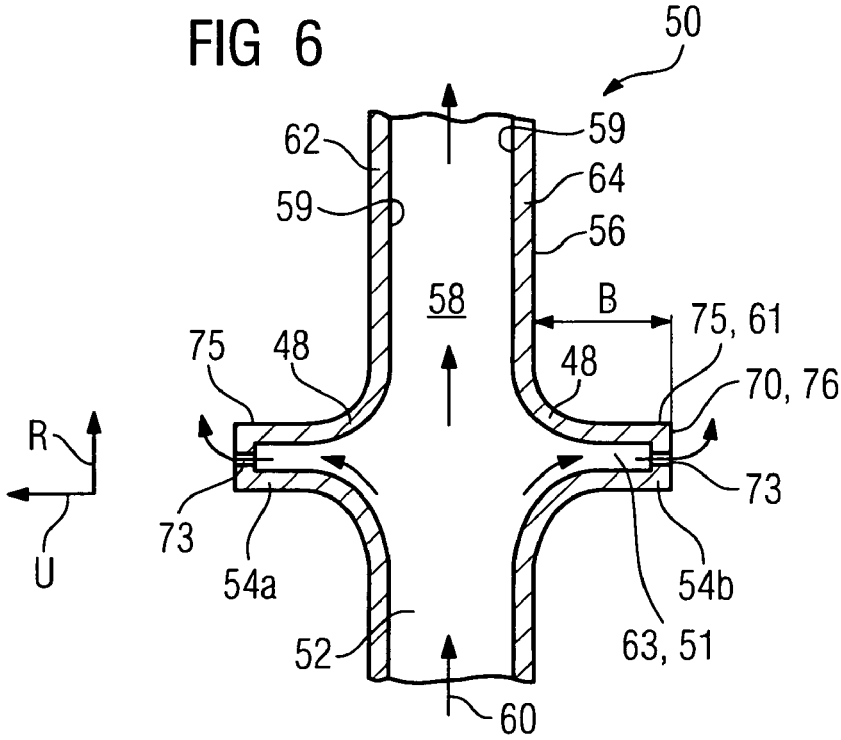

To divert the coolant 60, which flows in on the root side, in the direction of the recesses 63 and into the hollow platform 54, there is, as shown in FIG. 5 and FIG. 6, at least one outlet opening 73 for the coolant 60, which is provided at the outermost end of the recess 63 or pocket. In this case, preferably a plurality of outlet openings 73 distributed in the axial direction A are provided preferably both at the pressure-side platform 54*a* and at the suction-side platform 54*b*. On the exit side, each outlet opening 73 in accordance with FIG. 5 may be provided in the surface 61 of the platform 54, which is exposed to hot gas, or in the lateral platform longitudinal edge 55 of the platform 54 (FIG. 6). Without outlet openings 73 of this type, standing coolant swirls and what are known as dead water regions with reduced heat transfer would form in the partial cavities 51 of the turbine blade 50 shown in FIG. 5 and FIG. 6, i.e. in this case, coolant would flow through the turbine blade 50 substantially in the radial direction. On account of the outlet openings 73, coolant 60 will flow through the entirety of the partial cavities 51, and during this process will realize extremely efficient cooling of the platform 54, which is exposed to hot gas, and its transition to the blade profile 56.

The configuration of the outlet openings 73 shown in FIG. 5 has the advantage that they can be designed at an inclination with respect to the axial direction A, in order to allow additional, particularly effective film cooling of the surface 61 of the platforms 54. In particular on account of the recesses 63 penetrating relatively deep into the platform 54, it is possible to achieve a particularly favorable angle of hole, which effects particularly efficient film cooling.

In the configuration shown in FIG. 6, the coolant 60 which is blown onto the platform 54 at the end side is advantageously used to block the gap which has formed between two opposite end sides of platforms 54 of adjacent turbine blades 50.

Figure 7:
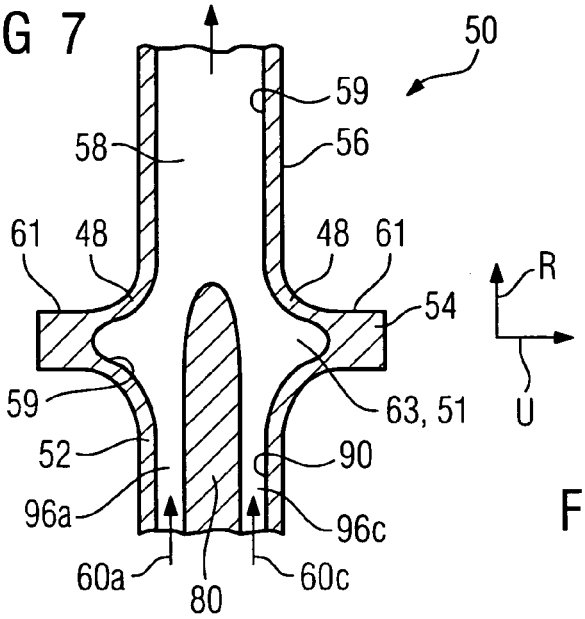

In a further variant of the invention, as shown in FIG. 7, the turbine blade 50 according to the invention, instead of outlet openings 73, has a pin 80 which extends centrally within the cavity 58 and extends from the blade root 52 at least into the platform region. The cavity 58 is divided on the root side into two supply passages 96*a* and 96*c*, through which the coolant 60 can flow into the hollow turbine blade 50, by the pin 80. The pin 80 causes the coolant 60 to be displaced toward the edge of the cavity 58, i.e. toward the inner wall 59, so that convective cooling of the blade root 52 and of the hollow platform 54 in the transition region 48 can be achieved.

Figure 8:
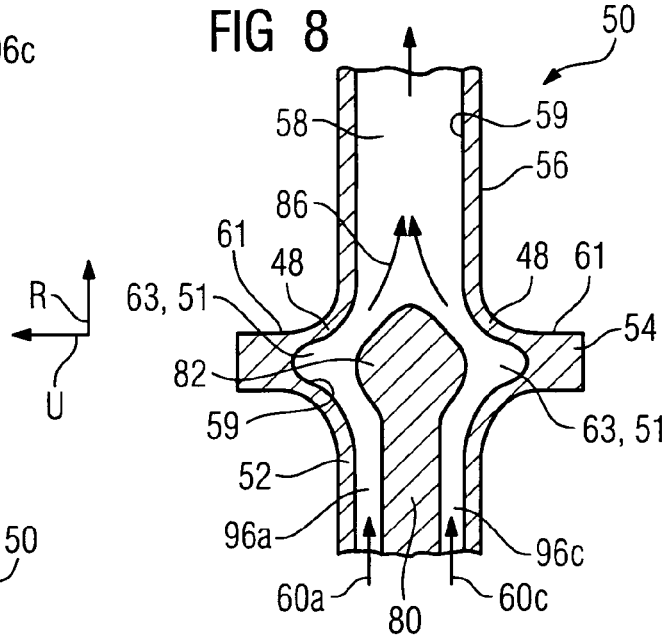

In another configuration according to the invention, FIG. 8 shows a turbine blade 50 similar to that shown in FIG. 7, but with a pin 80 which extends into the cavity 58 and widens in the transverse direction in the region of the platform 54, i.e. in the shape of a balloon in the transverse direction. The widening 82 is realized in such a manner that the cavity 58 has a cross-sectional flow which remains substantially constant along the blade root 52 into the region of the platform 54. The widening 82 of the pin 80 forces the coolant 60 which flows in on the root side to be diverted so that it is diverted into the recesses 63 and flows into a considerable depth without outlet openings being required for this purpose. Consequently, the platform 54 can be cooled in a closed formation.

After two coolant streams 60*a*, 60*c* which flow into the supply passages 96*a*, 96*c* on the root side have been passed into the recesses 63 to cool the platform 54, these coolant streams are combined in the blade profile 56, where the coolant 60 can be used to cool the blade profile 56 using a conventional cooling method, such as for example impingement cooling, convective cooling, film cooling or effusion cooling.

Figure 9:
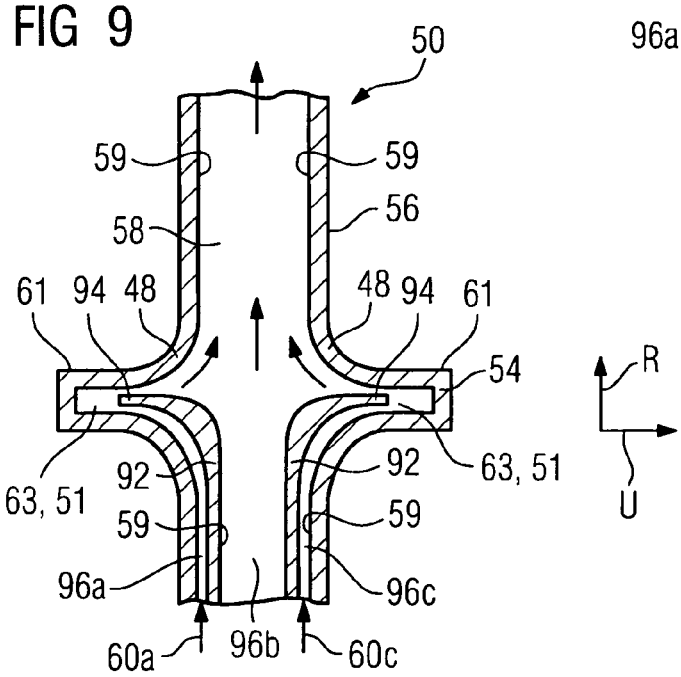

FIG. 9 shows a further variant embodiment of the invention. In the interior of the cavity 58, the turbine blade 50 has two sheet-like guiding elements 92 which are L-shaped in cross section and are provided at a distance from the inner wall 59 delimiting the cavity 58. The guiding elements 92 extend from the blade root 52 into the platform region and run parallel to the contour of the inner wall 59. In the blade root 52, they initially extend substantially in the radial direction and then, at the level of the platform 54, bend in the transverse direction U so that their free ends 94 penetrate deep into the recess 63 in the hollow platform 54.

The two guiding elements 92 divide the cavity 58 into three supply passages 96*a*, 96*b* and 96*c* on the blade root side. The coolant 60 which flows in via the supply passages 96*a*, 96*c* convectively cools the platforms 54 of the turbine blade 50 according to the invention, since the guiding elements 92 force the coolant 60 to be diverted into the recesses 63. By contrast, the coolant 60 which flows in via the supply passage 96*b* can flow into the blade profile 56 without being used by the blade root 52 and the platform region, and can be used in the blade profile 56 to cool for the first time the latter.

Consequently, these solutions allow coolant 60 to be passed in targeted fashion into the recesses 63 and/or the partial cavity 51, so as to form closed platform cooling, which leads to particularly efficient cooling of the platform 54 and of the transition region 48 or the transition radius. Moreover, on account of the approximately constant platform width B along the axial direction A, particularly uniform cooling of the transition is possible.

The turbine blades 50 proposed in FIGS. 7, 8 and 9 are produced by a casting process in which specially designed casting cores with undercuts are used to form the cavity.

Figure 10:
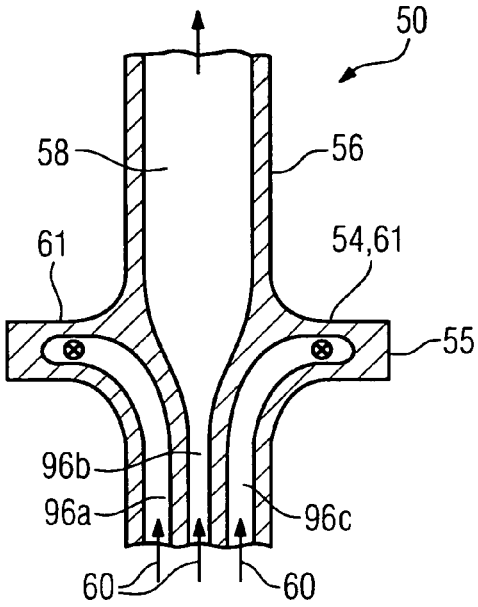
FIG. 10 shows the turbine blade illustrated in FIG. 12 in cross section on section X.
Figure 11:
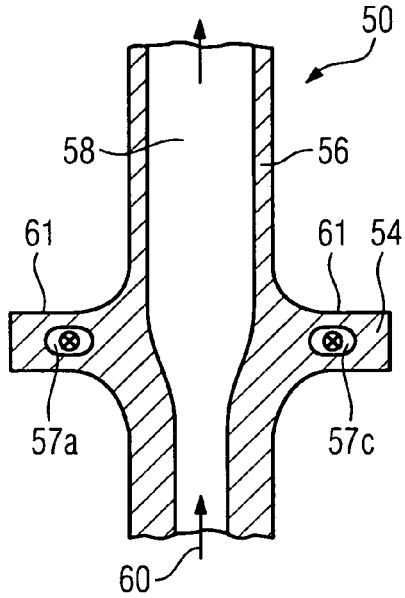
FIG. 11 shows the turbine blade shown in FIG. 12 in cross section on section XII and FIG. 12 shows a plan view of a turbine blade with cooling passages cast in along the platform longitudinal edge.
Figure 12:
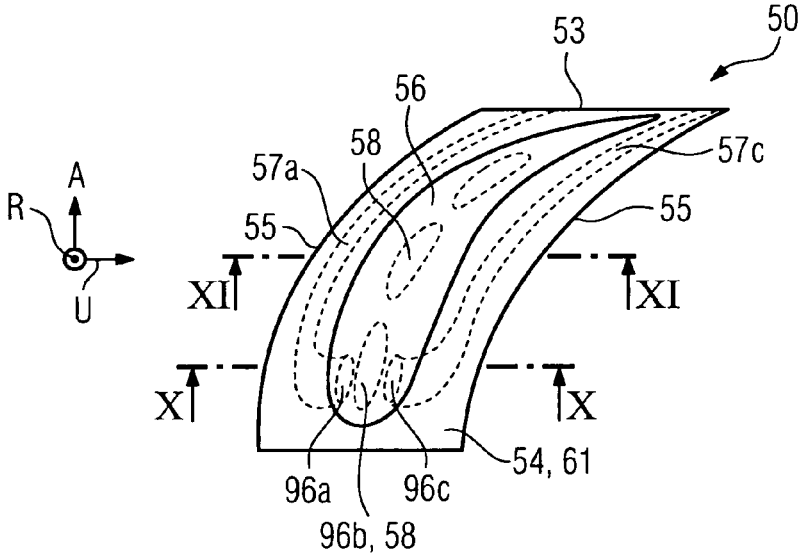

A final variant of a turbine blade 50 according to the invention is shown in cross section in FIG. 10, FIG. 11 and in plan view in FIG. 12. The turbine blade 50 has the curved blade profile 56, which is adjoined in the transverse direction U by a platform 54. The platform longitudinal edges 55, which run in the axial direction A, and the blade root 52 are curved convexly or concavely to match the curvature of the blade profile 56, which likewise runs in the axial direction A.

To illustrate the geometry shown, FIG. 10 shows a section X through the turbine blade 50 shown in FIG. 12. On the root side, in the region of the leading edge, the turbine blade 50 has three supply passages 96*a*, 96*b*, 96*c*, via which coolant 60 can flow in.

The supply passage 96*b* is arranged centrally on the leading side and passes coolant 60 into the hollow blade profile 56. The supply passages 96*a* and 96*c* are provided adjacent to it on the pressure side and the suction side. In the blade root 52, the supply passages 96*a*, 96*c* initially run substantially in the radial direction, and in the region of the platform 54 they bend in the transverse direction and then in the axial direction A, so that they form the hollow platforms 54. Consequently, the coolant 60 is supplied in the root-side end of the turbine blade 50.

The supply passages 96*a*, 96*c* merge into cooling passages 57*a*, 57*c* which run in the axial direction A along and approximately parallel to the curved platform longitudinal edges 55 by virtue of guiding elements 92, starting from the blade root 52, extending in the direction of the platform region and merging into the inner wall 59, delimiting the cavity 58, of the blade profile 56.

FIG. 11 shows the turbine blade 50 shown in FIG. 12 in a second section XI. The cooling passages 57 run in the axial direction below the surface 61 of the platforms 54 and open out at the platform transverse edge 53 of the platform 54.

The turbine blades 50 shown preferably have the blade root 52 and platform 54 designed with a curvature in the axial direction of the gas turbine, so that there are no asymmetric overhangs of platforms 54 formed. On account of the associated more uniform platform width (platform overhang along the axial direction), all the novel cooling concepts are particularly simple and particularly efficient in use.

Overall, the invention provides novel cooling concepts for gas turbine blades as running blades and vanes as guiding blades which have platforms which can be cooled particularly efficiently and uniformly. On account of the more uniform cooling, the fatigue service life of the turbine blade is lengthened. The platforms which are of hollow design can be internally cooled convectively either by means of suitable pins or guiding elements and/or by the provision of bores for producing a discharge of cooling air. The excellent coolability of the platforms also allows particularly efficient use of TBC coatings (thermal barrier coating). Moreover, it is possible to save cooling air compared to the platform cooling concepts which have been known hitherto and this cooling air can then be burnt in the gas turbine, increasing the efficiency of the latter.

The invention claimed is:

1. A turbine blade or vane for a gas turbine, comprising:

a blade or vane root that is successively adjoined by a platform region with a transversely extending platform and then a blade profile that is curved in the longitudinal direction;

a platform surface that is provided at the platform and exposed to hot gas; and at least one cavity that is open on the root side, through which a coolant can flow and which extends through the blade or vane root and at least into the platform region and is surrounded by an inner wall, and having a contour that extends in the platform region and is set back with respect to a contour extending in the blade or vane root so as to form a recess that widens the cavity, wherein the recess that widens the cavity extends into the region below the platform surface to form an at least partially hollow platform and in that there is at least one means for diverting the coolant into the partial cavity, wherein at least one outlet opening, through which the coolant can flow out of the partial cavity, is provided in the partial cavity for guiding the coolant, wherein the outlet opening opens out into the platform surface or into an end side of the platform, and wherein a pin is located in the cavity and extends from the blade or vane root at least into the platform region, is provided as means for guiding the coolant.

2. The turbine blade or vane as claimed in claim 1, wherein the pin, in the platform region, has a widening, such that the coolant can flow along the pin is diverted in the direction of the partial cavity.

3. The turbine blade or vane as claimed in claim 1, wherein at least one guiding element that is L shaped in cross section extends from the blade or vane root toward the platform region as means for guiding the coolant, with a plurality of limbs of this guiding element, at the end located in the platform region, at least partially projecting into the hollow partial cavity.

4. The turbine blade or vane as claimed in claim 1, wherein at least one guiding element extends from the blade or vane root toward the platform region as means for guiding the coolant, and this guiding element merges into the inner wall, delimiting the cavity, of the blade or vane profile.

5. The turbine blade or vane as claimed in claim 1, wherein the blade or vane root runs in the longitudinal direction of the blade or vane profile and the platform has two platform longitudinal edges bent parallel and extending in the longitudinal direction and the respective blade or vane root surface facing the suction-side and pressure-side profile walls are convexly and concavely curved in a corresponding way to the associated platform longitudinal edges.

6. The turbine blade or vane as claimed in claim 5, wherein the suction-side and/or pressure-side platform overhang is designed as a platform stub with a relatively short platform width.

7. The turbine blade or vane as claimed in claim 5, wherein the blade or vane root is of dovetail, hammer or fir tree shape as seen in cross section.

8. The turbine blade or vane as claimed in claim 1, wherein the blade or vane is cast.

9. The turbine blade or vane as claimed in claim 1, wherein the turbine blade or vane is used in a stationary gas turbine.

* * * * *